US011654530B2

(12) United States Patent
Giovannini

(10) Patent No.: US 11,654,530 B2
(45) Date of Patent: May 23, 2023

(54) PORTABLE APPARATUS FOR CLEANING SURFACES

(71) Applicant: IBIX S.R.L., Lugo (IT)

(72) Inventor: Caterina Giovannini, Santa Maria in Fabriago (IT)

(73) Assignee: IBIX S.R.L., Lugo (IT)

( * ) Notice: Subject to any disclaimer, the term of this patent is extended or adjusted under 35 U.S.C. 154(b) by 426 days.

(21) Appl. No.: 16/761,619

(22) PCT Filed: Nov. 6, 2018

(86) PCT No.: PCT/IT2018/050215

§ 371 (c)(1),
(2) Date: May 5, 2020

(87) PCT Pub. No.: WO2019/087225

PCT Pub. Date: May 9, 2019

(65) Prior Publication Data

US 2021/0170546 A1 Jun. 10, 2021

(30) Foreign Application Priority Data

Nov. 6, 2017 (IT) ..... 102017000126095

(51) Int. Cl.
*B24C 3/00* (2006.01)
*B24C 3/06* (2006.01)
*B24C 7/00* (2006.01)

(52) U.S. Cl.
CPC ..... *B24C 3/06* (2013.01); *B24C 7/0061* (2013.01)

(58) Field of Classification Search
CPC .... B24C 5/04; B24C 7/00; B24C 9/00; B24C 7/0053; B24C 7/0092; B24C 3/06; B24C 11/00; B24C 7/0046; B24C 7/0061; B24C 7/0069; B05B 7/00; B05B 7/0093; B05B 7/02; B05B 7/04; B05B 7/0408; B05B 7/14; B05B 7/1459; B05B 7/24; B05B 7/2472; B05B 7/26; B05B 7/28; B05B 12/14; B05B 7/145
USPC ..... 451/99, 446
See application file for complete search history.

(56) References Cited

U.S. PATENT DOCUMENTS 3,631,631 A 1/1972 Greenstein
5,319,894 A 6/1994 Shank, Jr.
5,591,064 A * 1/1997 Spears, Jr. ..... B24C 11/00 451/39
7,040,959 B1 5/2006 Panuska et al.
(Continued)

FOREIGN PATENT DOCUMENTS

DE 20 2016 1 01964 U1 4/2016
WO 2016020877 A1 2/2016

*Primary Examiner* — Katina N. Henson
(74) *Attorney, Agent, or Firm* — McGlew and Tuttle, P.C.

(57) ABSTRACT

The portable apparatus for cleaning surfaces comprises a tank (2) associated with a base (3), said tank (2) comprising at least one couple of chambers (5) predisposed to contain respective abrasive materials, said chambers (5) being hermetically separated from one another; at least one couple of mixing valves (13) associated with said base (3) and connected with respective said chambers (5) each said mixing valve (13) being predisposed to receive said abrasive material contained in said respective chamber (5) and to mix said abrasive material with a predetermined amount of compressed air.

20 Claims, 5 Drawing Sheets

(56) References Cited

U.S. PATENT DOCUMENTS

| | | | | |
|---|---|---|---|---|
| 7,052,362 | B2 * | 5/2006 | Lynn | B24C 11/00 451/100 |
| 8,308,525 | B2 | 11/2012 | Hashish et al. | |
| 2005/0107005 | A1 | 5/2005 | Lynn | |
| 2008/0176487 | A1 | 7/2008 | Armstrong | |
| 2013/0005220 | A1 | 1/2013 | Kountotsis et al. | |
| 2014/0065933 | A1 | 3/2014 | Haramboure et al. | |
| 2017/0225295 | A1 * | 8/2017 | Giovannini | B24C 7/0053 |

* cited by examiner

PORTABLE APPARATUS FOR CLEANING SURFACES

TECHNICAL FIELD

The present invention relates to a portable apparatus for cleaning surfaces, in particular of artefacts, buildings, architectural elements and the like.

BACKGROUND ART

It has long been known the use of apparatuses for cleaning surfaces through a process known as sandblasting.

The sandblasting consists in propelling a jet of compressed air and abrasive material on the surface to be treated so as to remove the superficial layer of material. Alternatively, sandblasting can be used for creating inscriptions or images on marble, stone, wood or glass.

Traditional cleaning apparatuses comprise a tank for abrasive material connected, through a mixing valve, to a mixing chamber in which a predetermined flow of compressed air, generally produced by a compressor, is conveyed. A sprayer gun provided with commands for spraying, through a suitable nozzle, a jet of air and abrasive material is connected with the mixing chamber through connecting means.

Patent US 2014/0065933 discloses a type of cleaning apparatus comprising a hopper, associated with a framework at the top thereof, predisposed to contain a sandy material. In a lower part of the hopper, a mixing chamber is placed, being predisposed to receive the sandy material and air. In the chamber a vertical duct is inserted for the access of the air, connected with an air adjusting system. The chamber is connected, through an outlet duct, with a sprayer gun so as to enable the passage of the flow of air and sand. A duct for the water supplied by a suitable pump is connected as well with the gun in order to enable spraying of a flow of air, sand and water through a nozzle placed at one end of the sprayer gun.

Further examples of surface cleaning apparatus are shown respectively in U.S. Pat. No. 5,319,894 and in international application WO201620877 on behalf of the Applicant.

Cleaning apparatuses use abrasive materials such as, for example, carbonates or silica abrasives.

To perform an optimal surface treatment, it is sometimes necessary to combine abrasive materials presenting different characteristics. It has been observed, for example, that the treatment of rusty surfaces is more effective if a mixture comprising a first abrasive material comprising small grains and a second abrasive material comprising larger grains is used. In fact, their combined action enables the layer of rust to be effectively removed, acting also on the rust settled at the level of the surface irregularities such as craters or similar, which is typically hardly removable.

In cases where treatment is required with at least two abrasive surfaces, the operator proceeds to mix materials in a suitable container that is not generally associated with the apparatus, in order to obtain a homogeneous mixture, and place the mixture in the tank of the apparatus.

Patent US 2005/0107005 illustrates a type of the apparatus that requires the use of at least two abrasive materials. The apparatus comprises a tank which forms a chamber inside, predisposed for containing different types of abrasive materials. These materials are inserted in predetermined quantities in the chamber and are mixed inside the chamber itself through a mixing member. Below the tank a conveying duct is placed, which is connected to means for supplying a flow of compressed air. The conveying duct is associated with the tank by means of a discharge duct, predisposed to enable the mixture to be discharged from the tank to the conveying duct.

A complained issue relates to the fact that the mixing preparation operation increases the operating time necessary to prepare the apparatus for the treatment.

Another complained issue concerns the amount of components that make up the mixture that cannot be easily changed. In fact, if the operator wishes to make changes to the mix in terms of percentage by weight of components, he must make the mixture again using the desired quantities of components and pour it into the water tank equipment, from which the previous mixture has been previously removed. Moreover, the mixture is not easily reproducible with high accuracy. This problem is especially relevant where high precision surface treatments are required for which it is appropriate to identify the correct proportion of materials in the mixture in order to achieve the desired effect through the treatment.

The task of modifying the composition of the mixture is laborious and increases operating times.

A solution to this problem is described in U.S. Pat. No. 5,591,064. The patent describes an apparatus for cleaning surfaces that includes a couple of tanks, predisposed to contain their abrasive materials and/or additives. Each tank is connected to a circuit to supply a flow of compressed air, predisposed to convey the compressed air into the tanks, in order to exercise a predetermined pressure on abrasive material. The compressed air supply circuit is also designed to convey a flow of compressed air in a collecting duct, in which the material is discharged from the respective tanks. Each tank is associated with a discharge duct of the abrasive material, connected with the collecting duct, and each discharge duct has a relative control valve, predisposed to enable the adjustment of the amount of abrasive material to be discharged from the tank to the collecting duct. The compressed air supply circuit comprises means for adjusting the pressure which enable the desired pressure value to be set in the tanks.

The described solution enables the modification, during use, of the amount of abrasive materials to be mixed without having to mix in proportions the materials before placing them in the tank.

Despite the achieved result, there remains, however, the need to further improve the efficiency of treatment that uses different abrasive materials.

DISCLOSURE

The object of the present invention is to solve the aforementioned problems by devising an apparatus which enables efficient cleaning of the surfaces by taking advantage of the combined action of at least two abrasive materials.

As part of this task, a further objective of the present invention is to provide an apparatus for cleaning surfaces that would perform a treatment in easily reproducible way and with high accuracy.

A further object of this invention is to devise an apparatus that may have versatile application.

A further object of the invention is to provide an apparatus for cleaning surfaces which enables the operating times necessary for carrying out the treatment to be reduced.

A further object of the invention is to provide an apparatus for cleaning surfaces of simple construction concept and functional, definitely reliable in operation and of relatively cheap cost.

The objects mentioned above are achieved, according to the present invention, by the portable apparatus for cleaning surfaces according to claim 1 and by the method for cleaning surfaces according to claim 11.

The apparatus includes a base, a tank associated with the base at the top thereof, said tank including at least a couple of chambers, said chambers being hermetically separated from one another. At least one couple of mixing valves are associated with said base and connected to said respective chambers, each mixing valve being predisposed to receive said abrasive material contained in said relative chamber and to mix said abrasive material with a predetermined amount of compressed air.

The apparatus includes a circuit for adjustment and distribution of compressed air including compressed air conducting means predisposed to conveying said compressed air in said chambers and in said mixing valves and a fitting assembly predisposed to connect these said mixing valves with spraying means predisposed to spray at least one flow of compressed air mixed with at least one abrasive material.

It is noted that a provision of a tank including at least a couple of chambers and a mixing valve for each chamber enables an optimal flow to be obtained as far as an initial mixing operation is implemented in each valve and a subsequent mixing operation in the fitting assembly.

The following mixing operations enable a more homogeneous spraying of the materials to be obtained in the resulting flow. It is also noted that the tank comprising separate chambers ensures a small size in order to contain respective abrasive materials.

Moreover, according to a mode of operation, the apparatus enables as well separately compressed air flows and abrasive material to be supplied ensuring versatility of use.

Preferably, the circuit for adjustment and distribution of compressed air comprises means for adjusting the pressure of said compressed air predisposed to enable the same pressure value of said compressed air to be selected in said chambers and/or to select independently for each said chamber a pressure value of said compressed air.

Preferably, said means for adjusting the pressure of said compressed air comprise a first pressure adjusting member predisposed to enable the selection of a pressure value of said compressed air in said chambers, said pressure value being substantially the same pressure value for said chambers.

According to one aspect of the invention, such means of pressure adjusting of said compressed air include a plurality of secondary pressure adjusting means predisposed to enable a value of pressure of the compressed air to be selected in each chamber independently, the number of said pressure adjusting members being equal to the number of said chambers.

Preferably said circuit for adjusting and spraying compressed air includes at least one couple of discharge valves, the number of said valves being at least equivalent to the number of mixing valves.

Preferably, each discharge valve is located upstream of a relative mixing valve.

Preferably each said discharge valve is operable between a first configuration, which enables the passage of said compressed air flow towards said relative mixing valve, and a second configuration, which enables the discharge of the residual compressed air present in the chamber corresponding to the mixing valve. It is therefore achieved the effect of rapidly discharging pressurized air which remains in the chambers of said tank when the operation of the apparatus is interrupted, thereby making the apparatus ready for subsequent use in a short time.

Advantageously, each discharge valve includes a first outlet for the passage of said compressed air flow from a said pressure adjusting member to said mixing valve, and a second outlet, predisposed to enable the discharge of compressed air from said relative chamber of said tank.

Preferably, said circuit for adjustment and distribution of compressed air comprises a non-return valve between each said adjusting member and said respective mixing valve, which enables a flow of monodirectional compressed air from said adjusting member to said mixing valve.

Preferably, between said non-return valve and said respective mixing valve a said discharge valve is interposed.

Preferably, said tank is closed at the top by a lid.

Preferably said tank includes a cylindrical or prismatic body defining a perimeter wall and at least one partition wall joined to the perimeter wall, said partition wall dividing the region of space delimited at the top and at the bottom respectively from said lid and from said base and on either side from the perimeter wall in regions of space separated and delimited on either side by a portion of the perimeter wall and a surface of at least one partition wall defining respective chambers.

Preferably, said dividing wall extends over the entire length of said tank.

Preferably said fitting assembly includes a mixing device predisposed to be connected to at least one couple of mixing valves in order to mix such flows of compressed air and abrasive materials coming from said mixing valves to obtain a resulting stream of compressed air and at least two abrasive materials mixed to be sprayed onto the surface to be treated.

Advantageously said mixing device is substantially Y shaped.

Preferably said mixing device shapes a first duct and a second duct flowing into a third duct, said first duct and said second duct being predisposed to convey its flows of an abrasive material and compressed air towards the third duct in which said flows are mixed in order to obtain the resulting flow of compressed air and at least two abrasive materials.

Alternatively, said fitting assembly includes at least one couple of attachment members predisposed to be associated at one end with respective mixing valves and at the opposite end with said relative spraying means by relative connecting means in order to supply separated flows of compressed air and of one said abrasive material.

Preferably each said mixing valve is provided with an adjusting system associated with a shutter member, said adjusting system being predisposed to enable the adjustment of the amount of abrasive material coming from said relative chamber, which must be mixed with compressed air flow.

Preferably, the apparatus comprises moving means connected to said base predisposed to enable said apparatus to be moved easily.

The present invention also relates to a method for cleaning surfaces that includes the step of preparing at least two different abrasive materials and insert these abrasive materials into respective separated chambers defined inside a tank.

Afterwards, the method involves mixing each said abrasive material to a flow of compressed air in order to obtain separated flows of compressed air and abrasive material.

The method provides then to mix said flows of compressed air and abrasive material so as to obtain a single flow of compressed air and at least two abrasive materials mixed and to spray said compressed air flow and at least two mixed abrasive materials to a surface to be treated.

DESCRIPTION OF DRAWINGS

The details of the invention will become more evident from the detailed description of a preferred embodiment of the portable apparatus for cleaning surfaces according to the invention, illustrated by way of example in the accompanying drawings, in which.

BEST MODE

Figure 1:
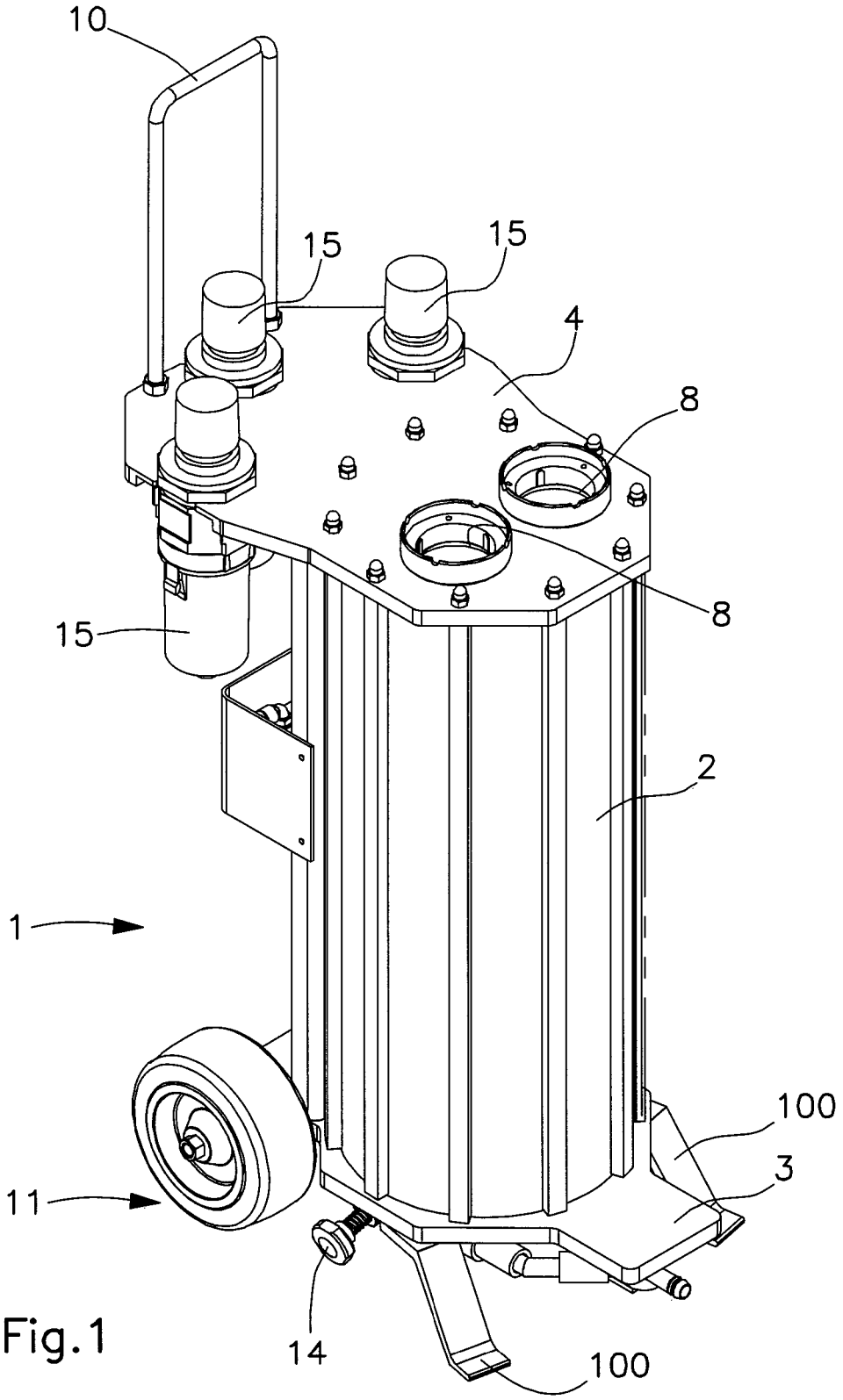
FIG. 1 shows a perspective view of the apparatus for cleaning surfaces according to the present invention.
Figure 3:
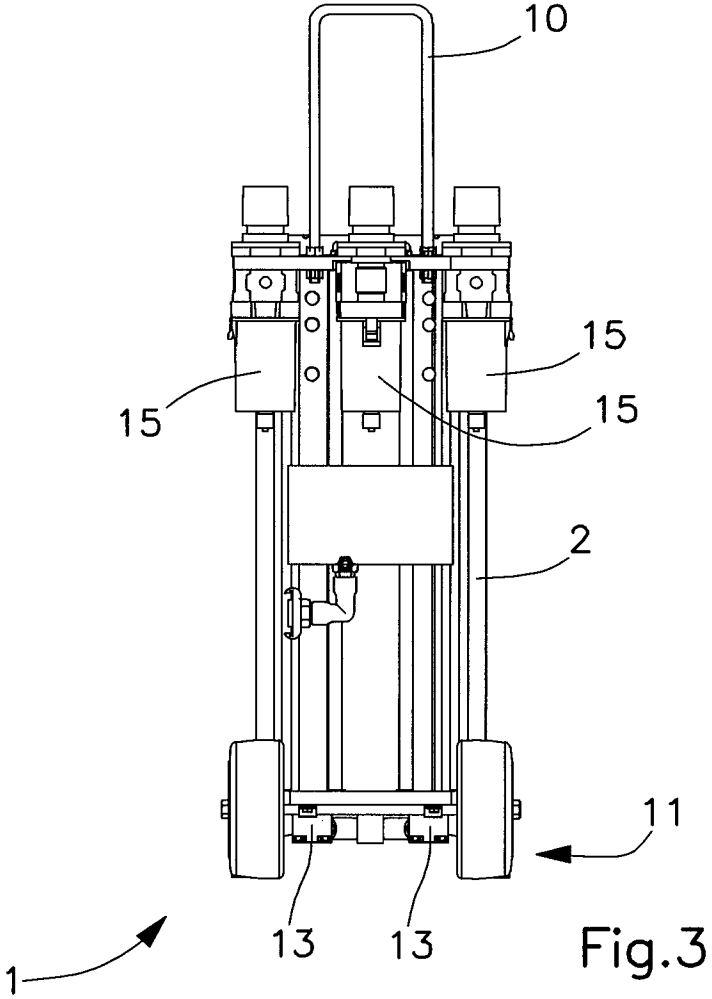
FIGS. 3 and 4 show respectively a rear view and a view from the bottom of the apparatus.
Figure 2:
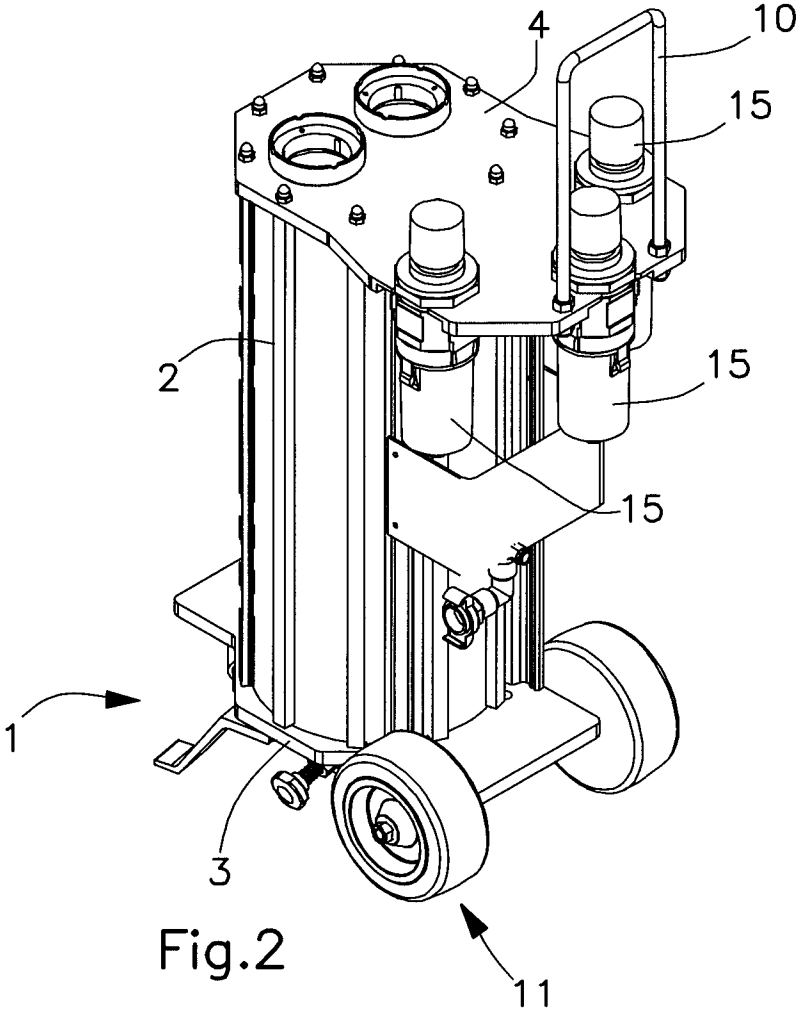
FIG. 2 shows a perspective view from a different angle of the apparatus.
Figure 8:
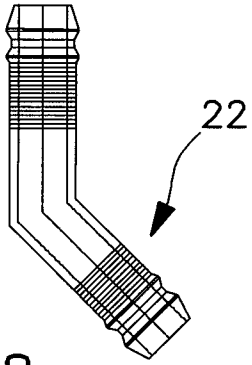
FIGS. 8 and 9 show top views of further details of the apparatus.
Figure 9:
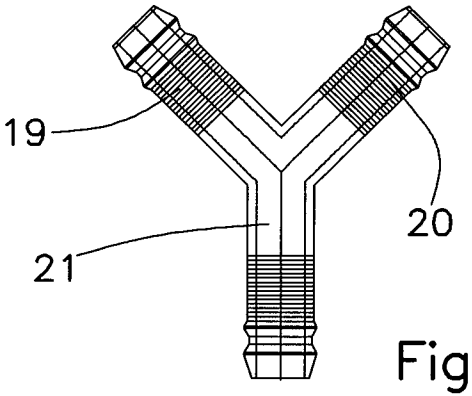
Figure 4:
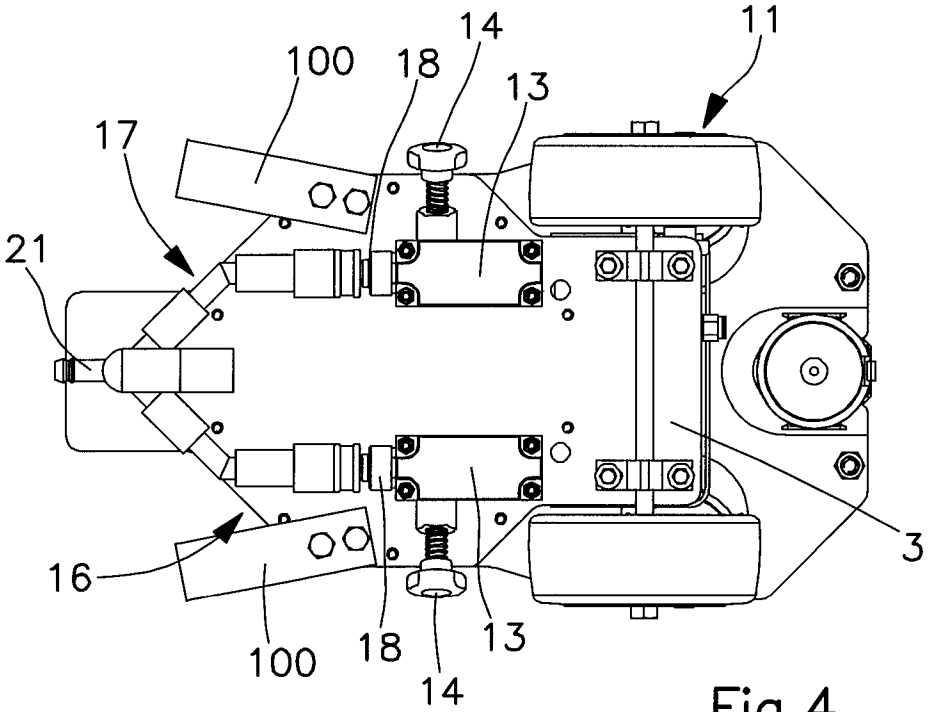

With particular reference to such figures, the apparatus for cleaning surfaces according to the present invention has been indicated in its entirety with 1.

The apparatus 1 comprises a tank 2 associated with a base 3 and it is closed at the top by a lid 4.

In particular, the tank 2 is mounted at the top of the base 3.

The tank 2 comprises at least a couple of chambers 5 predisposed to contain respective abrasive materials.

Abrasive materials can be, for example, mineral or vegetal or metal ferrous materials. Carbonates can be used as well, like sodium bicarbonate.

In the preferred embodiment shown in the figures the tank 2 comprise two chambers 5 and the following description refers to such an embodiment.

It is obviously possible that the number of chambers 5 may be a different number according to the requirements, for example three chambers 5.

The chambers 5 are predisposed to receive abrasive materials presenting different features, for example abrasive materials of different nature of materials of the same kind but with different grain sizes constituting the material.

The chambers 5 are hermetically separated from one another so as to prevent the passage of material from a chamber 5 to the adjacent one.

In particular, the tank 2 includes a preferably cylindrical or prismatic body that defines a perimeter wall 6 and at least one partition wall 7 joined to the perimeter wall 6.

The partition wall 7 divides the region of space delimited above and below respectively by the lid 4 and by the base 3 and at the sides by the perimeter wall 6 into regions of space separated and delimited at the sides by a portion of the perimeter wall 6 and by a surface of the at least one partition wall 7 defining respective chambers 5.

Preferably the at least one partition wall 7 extends along the entire length of the tank 2.

The tank 2 can be made by extrusion as one piece, otherwise it is possible to obtain the body of the tank 2 by extrusion and associate jointly the at least partition wall 7 with the perimeter wall 6.

In this case, the partition wall 7 is welded to the perimeter wall 6, at opposite ends, or is connected to the perimeter wall 6 using special type adhesive materials. like two-component mastics.

Figure 6:
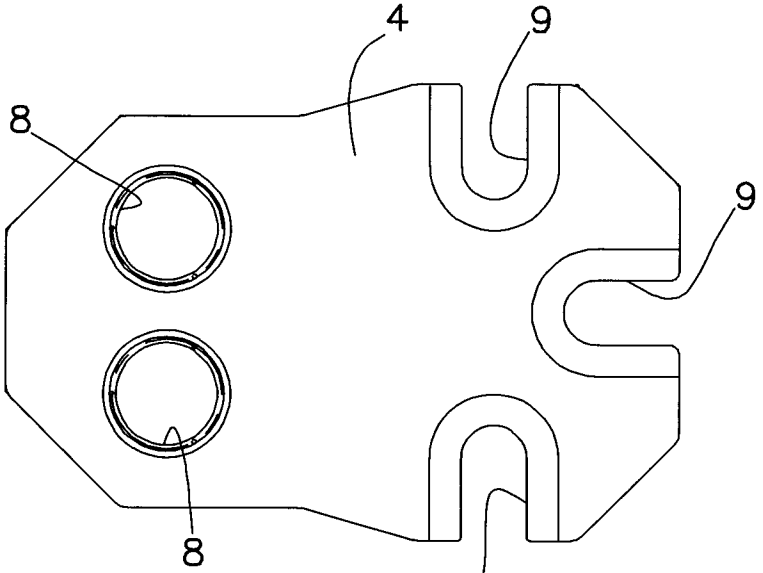
FIG. 6 and FIG. 7 show respective top views of further details of the apparatus.
Figure 5:
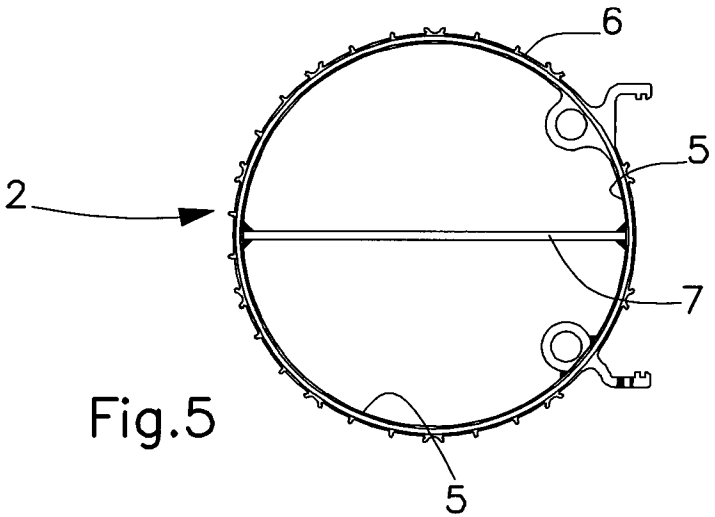
FIG. 5 shows a top view of a detail of the apparatus.
Figure 7:
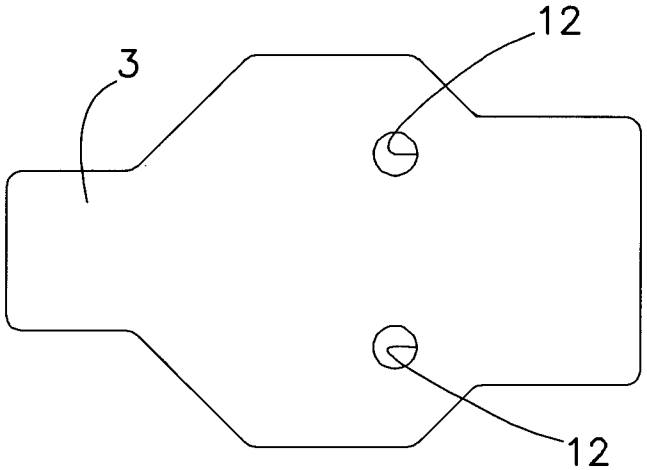

Preferably, the base 3 and the lid 4 are made of shaped plates of light material, for example of aluminium (see FIG. 6 and FIG. 7).

The lid 4 is provided with at least one couple of load openings 8, one for each chamber 5, predisposed to enable the insertion of respective abrasive materials inside the chamber 5 of the tank 2. It is intended to make on the lid 4 a number of load openings 8 equal to the number of the chambers 5.

A plurality of seats 9 are made on the lid 4 for housing members for adjusting the pressure of compressed air which, in operation, is inserted inside of the chambers 5, as will be better explained later.

A gripping member 10 of the type of a handle may also be connected to the lid 4 to ease the handling and the displacement of the device.

Preferably, moving means 11 predisposed to enable easy device displacement in the workspace is mounted on the base 3. Preferably, the moving means 11 includes a couple of wheels.

The base 3 can be provided as well with support feet 100 to stabilise the device when it is placed resting on the floor or on a workbench.

At least a couple of discharge openings 12 predisposed to enable the discharge of the abrasive materials from the respective chambers 5 towards corresponding mixing valves 13 are obtained on the base 3. A number of discharge openings 12 equal to the number of the chambers 5 is intended to be made, as well as for the load openings 8.

The mixing valves 13 are associated with the base 3 and are connected to the respective chambers 5 through the above mentioned discharge openings 12.

Each mixing valve 13 is predisposed to receive an abrasive material from the chamber 5 to which is connected and to mix the abrasive material with a predetermined amount of compressed air.

Each mixing valve 13 is provided with an adjusting system 14 associated with a shutter member, not shown in the figures, predisposed to enable the adjustment of the amount of the abrasive material which is discharged from the chamber 5 to the valve in order to be mixed to the flow of compressed air.

Each valve 13 comprises as well a nozzle, not shown, to spray the flow of the compressed air or abrasive material.

The compressed air is carried inside the mixing valves 13 by a circuit C for distributing and adjusting the compressed air.

This circuit C for distributing and adjusting the compressed air, hereinafter referred to as circuit, for simplicity, comprises compressed air conduction means, not visible in the figures, predisposed to convey the compressed air in the mixing valves 13 and in the chambers 5. Compressed air introduced into chambers 5 has the function of exercising a predetermined pressure on material and it is kept constant by the circuit C.

Compressed air is provided by a compressor and conveyed by means of a supply circuit, both not represented, to the circuit C associated with the apparatus 1.

The circuit C also comprises compressed air pressure adjusting means 15 that enables a same pressure value of the compressed air to be selected in the chambers 5 or an independent pressure value to be selected for each chamber 5.

Pressure adjusting means includes a first pressure adjusting member 15 predisposed to enable a same value of compressed air pressure to be selected in the chambers 5. According to an operating mode of the apparatus, the possibility of setting the same pressure value of the compressed air in the chambers 5 has the effect of obtaining an optimal flow of compressed air and mixed abrasive materials.

The pressure adjustment means also includes a plurality of secondary pressure adjusting members 15, predisposed to enable a value of compressed air pressure to be selected in each chamber 5 independently. In the operating mode of the apparatus that provides distinct flows of compressed air and abrasive material in output and therefore does not provide the mixing the different abrasive materials, the secondary adjusting members 15 enable the desired pressure value to be selected in each chamber 5, independently from the value set for the other chambers 5.

The number of used secondary adjusting members 15 equals the number of chambers 5 in which is divided the tank 2.

Pressure adjusting members 15 are preferably placed at the seats 9 shaped by the lid 4 in order to enable the operator to easily set the desired pressure value.

In the embodiment shown in the figures the apparatus includes a first adjusting member 15 and two secondary pressure adjusting members 15, one for each chamber 5.

The circuit C includes between each secondary adjusting member 15 and the respective mixing valve 13 a non-return valve Vr in order to enable the passage of a unidirectional compressed air flow from the secondary adjusting member 15 to the valve 13.

Between the first pressure adjusting member 15 and each mixing valve 13 is also placed a non-return valve Vr in order to enable a unidirectional flow of compressed air from the first pressure adjusting member 15 to each mixing valve 13.

A discharge valve Vs is placed upstream of each mixing valve 13. In particular, each discharge valve Vs is placed between each non-return valve Vr and the respective mixing valve 13.

Each discharge valve Vs can be operated between a first configuration, which enables a flow of compressed air to the mixing valve 13, and a second configuration, which enables the discharge of residual compressed air present in the related chamber 5.

Figure 10:
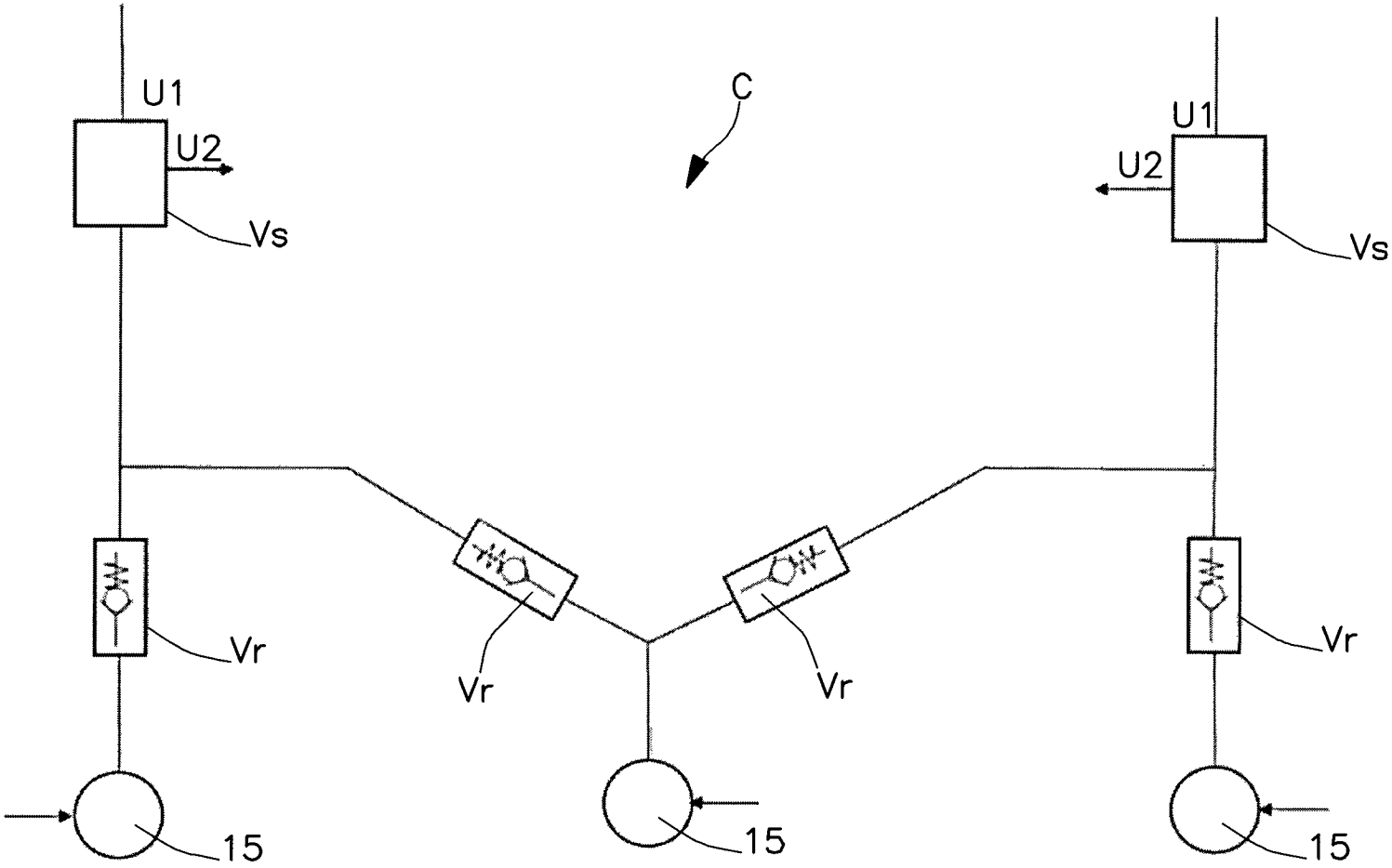
FIG. 10 show schematic representation of a circuit for adjustment and distribution of compressed air associated with the apparatus.

Each discharge valve Vs is provided with a first outlet U1 to enable the passage of compressed air from the adjusting member 15 to the mixing valve 13 and a second outlet U2 for the discharge of compressed air in case the compressed air flows in opposite direction, that is, from the mixing valve 13 to the adjusting member 15 (see FIG. 10).

The arrangement of the discharge valve Vs for each mixing valve 13 is particularly advantageous to operate a rapid discharge of the compressed air that remains in the chambers 5 when the apparatus is not in use. The discharge valve Vs enables the residual compressed air to be discharged from the chambers 5 of the tank 2 through the second outlet U2, making the apparatus rapidly ready for a later use.

The mixing valves 13 are connected to spraying means, not visible in the figures, by a fitting assembly 16 so as to supply at least a flow of compressed air mixed with at least an abrasive material.

The fitting assembly 16 includes a mixing device 17 predisposed to be connected to at least one couple of mixing valves 13 in order to mix the flows of compressed air and abrasive materials coming from the valves 13 in order to obtain a resulting flow of compressed air and at least two mixed abrasive materials.

In particular, the mixing device 17 is connected at one end to at least one couple of attachment members 18 associated with respective nozzles of the mixing valves 13. At the opposite end the mixing device 17 is associated with spraying means preferably by connecting means made up for example of a flexible hose.

Preferably the spraying means is made up of at least one sprayer gun through which it is provided a stream of compressed air and at least one abrasive material to treat a surface.

Preferably the mixing device 17 is substantially Y shaped.

More specifically, the mixing device 17 forms a first duct 19 and a second duct 20 confluent in a third mixing duct 21.

Preferably the mixing device 17 is manufactured in a single piece.

The mixing device 17 is made of an abrasion-resistant material, preferably of tungsten.

The first duct 19 and the second duct 20 are connected to the respective attachment members 18 of the mixing valves 13 so as to convey the relative flows of abrasive material and compressed air into the third mixing duct 21 in which the flows are mixed in order to obtain a single flow of compressed air and at least two abrasive materials. Specifically, the first duct 19 and the second duct 20 are associated with the relative connection members 22 which are connected to the respective attachment members 18 of the valve 13.

The operation of portable apparatus for cleaning surfaces is easily comprehensible from the description above.

Initially, the operator chooses the abrasive materials to be used in the treatment and places them into corresponding chambers 5 of the tank 2.

The desired pressure value to be set in the chambers 5 shall then be selected by means of the first pressure adjusting member 15.

At startup of the compressor, compressed air is brought through the supply circuit to the circuit C of the apparatus and the conducting means carries the compressed air to the chambers 5 and to the mixing valves 13.

The flows of compressed air and abrasive material flow from the respective mixing valves 13 in the mixing device 17 where abrasive materials are conveniently mixed.

The operator shall operate the sprayer gun to direct a compressed air flow and at least two mixed abrasive materials towards the surface to be treated.

In case the operator wishes to modify at run time of the treatment performance the percentage composition of the mixture, the amount of material to be mixed to the flow of compressed air in the respective mixing valve 13 can be adjusted by the adjusting system 14.

The operator can easily move the apparatus thanks to the couple of wheels 11 and to the handle 10, arranging it in the most comfortable place for the treatment performance.

According to a different embodiment of the invention, the fitting assembly 16 can be provided including at least a couple of attachment members 18 associated at one end with the respective mixing valves 13 and at the opposite end with the related sprayer guns by means of connection including for example flexible hoses in order to supply separate flows of compressed air and one said abrasive material. Each mixing valve 13 is then associated with a corresponding sprayer gun without the interposition of the mixing device 17.

Therefore, operators shall select by means of the secondary pressure adjusting members 15 the required pressure values in the single chambers 5 and activate the sprayer guns to supply separate flows of compressed air and abrasive material. In practice, this solution enables the use of the device as if it were a number of apparatus used in parallel and loaded with different abrasive materials.

At the end of the treatment performance, the operator deactivates the at least one sprayer gun and the discharge valves Vs enable the compressed air to be released from the chambers 5 to prepare the apparatus for a subsequent use.

The portable apparatus for cleaning surfaces achieves the desired objective of efficiently implementing a treatment using the combined action of at least two abrasive surfaces.

This is made possible by the provision of a tank provided with at least a couple of chambers hermetically separated from each other for the related abrasive materials which may be used where necessary in combination in treatment, as well as by the provision of a mixing valve for each chamber, which enables the separate mixing of each abrasive material with a stream of compressed air. In particular, it is emphasised that, if the apparatus is used in the way that requires a single resulting flow, it was noted that the obtained resulting flow presented excellent features, for example an excellent spraying of abrasive materials, as each abrasive material is mixed to a compressed air flow in the mixing valve and then a further mixing of flows including compressed air and abrasive materials is made in the fitting assembly.

An important aspect to consider is the versatility of the apparatus that can be used both to treat the surfaces with a flow comprising different mixed abrasive materials both to provide separate flows, each including one abrasive material. The latter usage is possible thanks to the presence of pressure adjusters arranged for the single chambers as well as for the opportunity to establish the connection of the mixing valves to the sprayer guns without the interposition of mixing device.

Also the apparatus achieves the objective of reducing the time required to perform the treatment as the operator shall not prepare previously the mixture and pour it into the tank while it is sufficient to arrange the materials in the chambers.

In addition the operator acts on the valve adjusting system to modify the mixture by reducing the time that would be needed to replace a mixture with a predetermined composition with a mixture of different composition.

Another prerogative of the present invention is that it enables the operator to modify in real time the number of components of the mixture by acting on the mixing valve adjusting systems that change the amount of materials introduced into valves. In practice, the operator, on the basis of the effect produced by the jet of abrasive materials on the surface, can easily make changes to the percentage composition of the mixture to check whether a positive effect is obtained. A real time adjustment is then made to the valve adjustment systems which enables an iterative process to be followed. This process leads to obtaining an optimal mixture composition in terms of the right quantities of the selected materials.

The apparatus enables then a more reliable, accurate, and especially easily reproducible treatment performance, whereas, once the parameters of the adjustment system associated with an optimal mixture are defined, the operator can repeat a subsequent treatment by simply setting the previously established parameters.

It has to be considered also that the mixing device enables the homogeneous mixing of the abrasive materials stowed in separate chambers.

One aspect to underline is the fact that it has been observed experimentally that the use of a pressure adjuster for selecting the same pressure value of the compressed air in the chambers enables the pressure exerted on the materials with a consequent optimal flow of compressed air and mixed materials to be precisely established.

Finally, the arrangement of a discharge valve for each mixing has the benefit to reduce the time needed to make the device ready for a subsequent use as it enables to reduce the time taken by compressed air to be discharged rapidly from the chambers. Thus, the wasting of abrasive material is limited, since, in the absence of a discharge valve, the discharge of the compressed air from the chambers is made by at least one sprayer gun resulting in the escape of abrasive material until the discharge is finished. The described apparatus by way of example is subject to numerous modifications and variations based on need.

In the practical implementation of the invention, the materials used, as well as the shape and size, may vary depending on needs.

Should the technical features mentioned in any claim be followed by reference signs, such reference signs were included strictly with the aim of enhancing the understanding of the claims and hence they shall not be deemed restrictive in any manner whatsoever on the scope of each element identified for exemplifying purposes by such reference signs.

The invention claimed is:

1. A portable surface cleaning apparatus comprising:

a base;

a tank associated with said base, at a top thereof, said tank comprising at least a plurality of chambers configured to contain respective abrasive materials, said chambers being hermetically separated from one another;

at least a plurality of mixing valves associated with said base and connected with said chambers, each of said mixing valves being configured to receive said abrasive material contained in one of said mixing chambers and to mix said abrasive material with a predetermined amount of compressed air;

a circuit for adjusting and distributing compressed air comprising a compressed air conducting means for conveying said compressed air into said chambers and into said mixing valves;

a fitting assembly configured to connect said mixing valves with a spraying means for spraying at least one flow of compressed air mixed with at least one of said abrasive materials, said fitting assembly further comprising a mixing device configured to be connected to said at least said plurality of mixing valves so as to mix flows of compressed air and abrasive materials coming from said mixing valves to obtain a resulting flow of compressed air and at least two abrasive materials to be sprayed on a surface to be treated.

2. The apparatus according claim 1, wherein said mixing device is substantially Y-shaped.

3. The apparatus according claim 2, wherein said mixing device shapes a first duct and a second duct confluent into a third duct, said first duct and said second duct being configured to convey relative flows of at least one of said abrasive materials and said compressed air to said third duct, wherein said flows are mixed to obtain said resulting flow of compressed air and at least two of said abrasive materials.

4. The apparatus according claim 1, wherein said mixing device shapes a first duct and a second duct confluent into a third duct, said first duct and said second duct being configured to convey relative flows of at least one of said abrasive materials and said compressed air to said third duct, wherein said flows are mixed to obtain said resulting flow of compressed air and at least two of said abrasive materials.

5. The apparatus according to claim 1, wherein said fitting assembly comprises at least a plurality of attachment members configured to be associated at one end with respective mixing valves and at an opposite end with respective said spraying means through respective connection means so as to spray separate flows of compressed air and said abrasive material.

6. The apparatus according to claim 1, wherein said circuit for adjusting and distributing compressed air comprises a pressure adjusting means for adjusting a pressure of said compressed air configured to enable at least one of a selection of a same pressure value of said compressed air in said chambers and an independent selection for each of said chambers of a pressure value of said compressed air.

7. The apparatus according to claim 6, wherein said pressure adjusting means comprises a first pressure adjusting member configured to enable the selection of said pressure value of said compressed air in said chambers, said pressure value being substantially the same pressure value of said chambers.

8. The apparatus according to claim 7, wherein said pressure adjusting members comprises a plurality of secondary pressure adjusting members configured to enable said selection of said pressure value of said compressed air in each of said chambers independently from each other, wherein a number of said secondary pressure adjusting members is equal to a number of said chambers.

9. The apparatus according to claim 6, wherein said pressure adjusting members comprises a plurality of secondary pressure adjusting members configured to enable said selection of said pressure value of said compressed air in each of said chambers independently from each other, wherein a number of said secondary pressure adjusting members is equal to a number of said chambers.

10. The apparatus according to claim 1, wherein said circuit for adjusting and distributing compressed air comprises at least a plurality of discharge valves, each of said discharge valves being placed upstream to a relative mixing valve, each of said discharge valves being operable between a first configuration and a second configuration, wherein a passage of said compressed air flow is provided towards said mixing valve in said first configuration and a discharge of residual compressed air present in said chambers is provided in said second configuration.

11. The apparatus according to claim 1, further comprising:

a moving means connected with said base configured to enable moving of said apparatus.

12. A method for surface cleaning, the method comprising the steps of:

preparing at least two different abrasive materials;

inserting said at least two different abrasive materials into respective separate chambers defined within a tank;

mixing each of said at least two different abrasive materials with a flow of compressed air by means of at least a plurality of mixing valves to obtain separate flows of compressed air and abrasive material;

mixing said flows of compressed air and abrasive materials, by means of a mixing device to obtain a single flow of compressed air and at least two mixed abrasive materials;

spraying said flow of compressed air and at least two mixed abrasive materials towards a surface to be treated.

13. A portable surface cleaning apparatus comprising:

a base;

a tank associated with said base, at a top thereof, said tank comprising at least a plurality of chambers configured to contain respective abrasive materials, said chambers being hermetically separated from one another;

a first mixing valve associated with said base and connected with one of said chambers, said first mixing valve comprising a first mixing valve outlet, said first mixing valve being configured to receive at least one of said abrasive materials contained in said one of said chambers and to mix said at least one of said abrasive materials with a predetermined amount of compressed air to provide a first mixture of compressed air and abrasive material;

a second mixing valve associated with said base and connected to another one of said chambers, said second mixing valve comprising a second mixing valve outlet, said second mixing valve being configured to receive at least one of said abrasive materials contained in said another one of said mixing chambers and to mix said abrasive material with a predetermined amount of compressed air to provide a second mixture of compressed air and abrasive material;

a circuit for adjusting and distributing compressed air comprising a compressed air conducting means for conveying said compressed air into said chambers and into said first mixing valve and said second mixing valve;

a fitting assembly configured to connect said first mixing valve and said second mixing valve with a spraying means, said fitting assembly comprising a fitting assembly mixing device, said fitting assembly mixing device comprising a fitting assembly mixing device outlet, a fitting assembly mixing device first inlet and a fitting assembly mixing device second inlet, said fitting assembly mixing device first inlet being connected with said first mixing valve outlet, said fitting assembly mixing device second inlet being connected with said second mixing valve outlet, wherein said fitting assembly mixing device is configured to mix said first mixture of compressed air and abrasive material from said first mixing valve with said second mixture of compressed air and abrasive material from said second mixing valve to provide a resulting flow of compressed air and abrasive material to said spraying means via said fitting assembly mixing outlet.

14. The apparatus according claim 13, wherein said mixing device is substantially Y-shaped.

15. The apparatus according claim 13, wherein said first assembly mixing device comprises a first duct, a second duct and a third duct, said first duct being configured to convey a flow of said first mixture of compressed air and abrasive material to said third duct, said second duct being configured to convey a flow of said second mixture of compressed air and abrasive material to said third duct, wherein said first mixture of compressed air and abrasive material is mixed with said second mixture of compressed air and abrasive material in said third duct.

16. The apparatus according to claim 13, wherein said fitting assembly comprises at least a plurality of attachment members configured to be associated at one end with respective mixing valves and at an opposite end with respective said spraying means through respective connection means so as to spray separate flows of compressed air and said abrasive material.

17. The apparatus according to claim 13, wherein said circuit for adjusting and distributing compressed air comprises a pressure adjusting means for adjusting a pressure of said compressed air configured to enable at least one of a selection of a same pressure value of said compressed air in said chambers and an independent selection for each of said chambers of a pressure value of said compressed air.

18. The apparatus according to claim 17, wherein said pressure adjusting means comprises a first pressure adjusting member configured to enable the selection of said pressure value of said compressed air in said chambers, said pressure value being substantially the same pressure value of said chambers.

19. The apparatus according to claim 17, wherein said pressure adjusting members comprises a plurality of secondary pressure adjusting members configured to enable said selection of said pressure value of said compressed air in each of said chambers independently from each other, wherein a number of said secondary pressure adjusting members is equal to a number of said chambers.

20. The apparatus according to claim 13, wherein the fitting assembly mixing device is located upstream of said first mixing valve and said second mixing valve with respect to a flow of said first mixture of compressed air and abrasive material.

* * * * *